United States Patent [19]

Cloud et al.

[11] 3,959,892

[45] June 1, 1976

[54] HEATED AIR RECYCLE ARRANGEMENT

[75] Inventors: Robert H. Cloud, Lexington, Ky.; Edward J. Hopton, Nashville, Tenn.

[73] Assignee: A.M. Industries, Lousiville, Ky.

[22] Filed: June 20, 1975

[21] Appl. No.: 588,677

Related U.S. Application Data

[63] Continuation of Ser. No. 493,525, Aug. 1, 1974, abandoned.

[52] U.S. Cl. ..... 34/131; 34/86; 34/133; 34/235

[51] Int. Cl.[2] ..... F26B 11/02

[58] Field of Search ..... 34/79, 85, 86, 130–134, 34/138, 139, 219, 235, 225; 110/49 R

[56] References Cited

UNITED STATES PATENTS

| | | | |
|---|---|---|---|
| 497,018 | 5/1893 | Diemer | 110/49 R |
| 1,014,573 | 1/1912 | Davis | 110/49 R |
| 3,157,391 | 11/1964 | Angelone | 34/133 |
| 3,771,238 | 11/1973 | Vaughn | 34/133 |

*Primary Examiner*—Kenneth W. Sprague
*Assistant Examiner*—James C. Yeung
*Attorney, Agent, or Firm*—Edward M. Steutermann

[57] ABSTRACT

The present invention provides a heated air recycle arrangement for a clothes dryer which can be advantageously used in a clothes dryer having an air supply; a heater arrangement for heating the air supplied by the air supply; a drying zone including having an inlet communicating with the air supply and an outlet, and further including receptacle means to retain clothes to be dried in the dryer; a blower to circulate heated air from the air supply through the drying zone; and an exhaust duct having an inlet communicating with the outlet from the drying zone and an outlet. The present invention provides a second duct having an inlet and an outlet where the second duct has a mean diameter less than the mean diameter of the exhaust duct wherein the second duct inlet and a selected portion of the length of the second duct are disposed generally concentrically within a portion of the length of the exhaust duct to form an annular air flow conduit between the wall of the exhaust duct and the portion of the wall of the second duct disposed within the exhaust duct is received by the inlet to the second duct and the outer portion of the air stream flowing through the exhaust duct passes through the annular conduit to the exhaust duct outlet, and where the outlet from the second duct communicates with the air supply to recirculate a portion of the air carried by the exhaust duct to the air supply.

7 Claims, 4 Drawing Figures

HEATED AIR RECYCLE ARRANGEMENT

BACKGROUND OF THE INVENTION

The present invention relates to an air recycle arrangement for use with a clothes dryer and is particularly useful in connection with commercial clothes dryers to reduce the amount of heat required to dry clothes in the commercial clothes dryer and is a continuation of application Ser. No. 493,525, filed Aug. 1, 1974, abandoned.

It will be recognized that the present invention, by reducing the heat requirements in a clothes dryer, provides an arrangement to reduce the cost of operation of clothes dryers and a means for reducing the energy required for operation of clothes dryers.

Some previous dryer arrangements, for example as shown in U.S. Pat. No. 2,314,748, have provided means to recycle a portion of the air flowing through a clothes dryer apparatus. Some such previous arrangements have included means for recycling a major portion of the air to be mixed with air received by the air inlet of the dryer so only a relatively small portion of the recirculated air is exhausted at any one time. However, in such arrangements where an indiscriminate portion of the air exhausted from the dryer is recirculated to the dryer air supply, the efficieny of the dryer can be adversely affected.

In other previous arrangements, as shown in U.S. Pat. No. 2,635,354, a portion of the air emitted from the drying zone of the clothes dryer has been directly recirculated to the drying zone without even mixing with incoming previously heated fresh air.

The present invention recognizes the advantage in recirculating a portion of the air exhausted from the drying zone of a dryer but further recognizes that there are distinct advantages provided by recirculating a selected portion of the air stream admitted from the dryer.

Accordingly, the present invention provides an arrangement where the exhaust air stream emitted from a drying zone is conducted through an exhaust duct means, with the inlet and a selected length of a second duct means, having a mean diameter less than the mean diameter of the exhaust duct, disposed in generally concentric relation with the exhaust duct to receive a central portion of the air exhausted from the dryer and recirculate the air to the clothes dryer.

In one presently preferred form of the present invention, the exhaust duct and the second duct, a portion of which is disposed concentrically within the exhaust duct are circular and the diameter of the second duct is 75% of the diameter of the exhaust conduit.

The present invention further recognizes that exhaust air from a dryer generally flows in a spiral path rather than in a straight line flow and that the force exerted on the air stream due to centrifical acceleration resulting from the helical path followed by the air stream, forces heavier moisture laden air toward the outside wall of the exhaust duct leaving an inner core of hot drier air which is the portion of the exhaust air stream advantageously received by the recycle conduit disposed centrally within the exhaust duct in accordance with one feature of the present invention, and that recycling this drier air to the clothes dryer decreases the heat required to dry the clothes carried in the drying zone of the clothes dryer.

BRIEF DESCRIPTION OF THE DRAWINGS

Referring now to FIG. 1, a typical commercial dryer as shown which can be enclosed in a cabinet 1, having louvered openings 2 for admission for an air stream 3. Air stream 3 flows through a combustion chamber 4 defined within cabinet 1 by walls 5. As shown in FIGS. 1 and 2 burners 6 are provided within chamber 4 to heat the air stream 3 admitted through louvers 2. Burners 6 can be adapted to burn a selected fuel, for example natural gas, where the flow of gas to burners 6 can be controlled by control means which are well known in the art but not shown in the drawings. Air stream 3 flows into combustion chamber 4 and flows over burners 6 to be heated by the flames of burners 6. As best shown in FIG. 2, heated air stream 7 flows out of combustion chamber 4 into a drying zone 33 described hereinafter, by means of an opening 8 provided in the bottom of chamber 4. Drying zone 33 is defined in cabinet 1 and provides room, inter alia for a rotatable basket 11, as shown in FIGS. 1 and 2, to be disposed within the drying zone 33 where basket 11 is disposed across the width of cabinet 1 so that heated air stream 7 emitted from burner chamber 4 to drying zone 33 passes through basket 11. Basket 11 is adapted to receive, for example clothing to be dried, through a door in the front of cabinet 1 (not shown) which communicates with a cooperative opening in basket 11. Basket 11 is disposed in drying zone 33 for rotation about its longitudinal axis and, for example is supported for rotation by cooperative bearings (not shown). Basket 11 is rotated by motor 12, which can be, for example, an electric motor operated by the control mechanism (not shown) provided by the dryer. Motor 12 can be cooperatively adapted to rotate basket 11 through power transmission means, for example a belt drive arrangement, well known in the art and not shown in the drawings.

Figure 1:
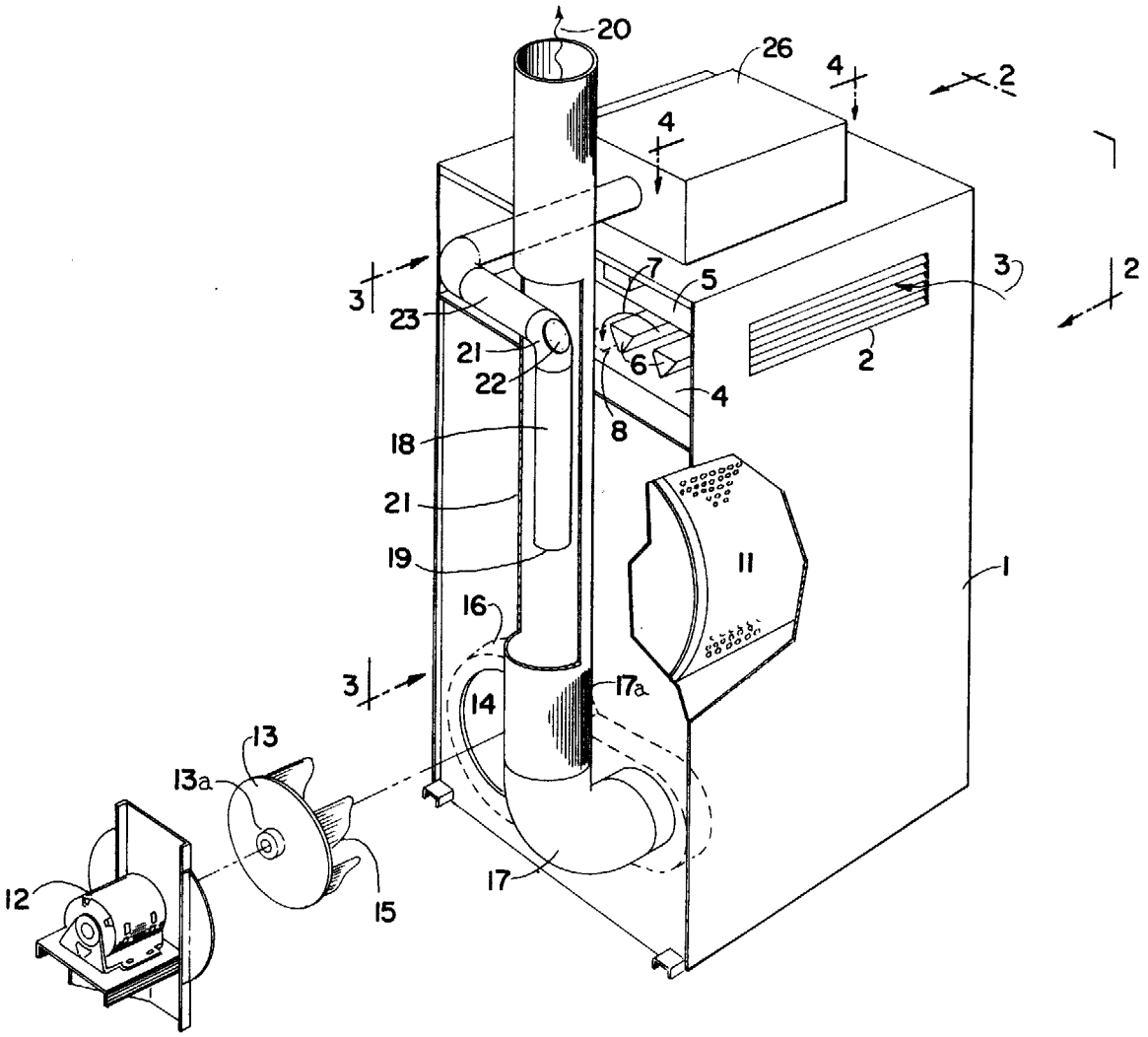
FIG. 1 is a partially fragmentary, partially exploded, perspective view of a typical commercial dryer adapted to receive one example of an air recirculation arrangement in accordance with the present invention.

As is well known in the art, as basket 11 is rotated in drying zone 33, heated air flows through basket 11 to dry the clothes or other goods carried by basket 11. Air flow through dryer cabinet 1 can be provided by any of the means known in the art and in the example shown in the Figures, air flow through cabinet 1 is induced by blower wheel 13 provided to be connected to motor 12 by means of a coupling **13*a* for rotation by motor 12. Blower wheel 13 is received in a cooperative aperature 14 provided in bacinet of a housing 16 having an inlet (not shown) provided in cabinet 1 to communicate with drying zone 33 defined within cabinet 1 at a location beneath basket 1 and has an outlet communicating with exhaust 17 as described hereinafter. Blower 13 as shown is inserted through aperature 14 and is received in housing 16 so that when blower wheel 13 is rotated, blades 15 of wheel 13 cause a flow of air through housing 16 from drying zone 33 to exhaust 17 to induce a flow of air through cabinet 1 so air stream 3 is drawn into cabinet 1 through louvers 2, through combustion chamber 4 over burners 6 and through inlet 8 to drying zone 33 where the air stream passes through basket 11 to dry the clothes disposed in basket 11. After passing through basket 11 the air stream, which has picked up moisture from the goods in basket 11, enters housing 16 to be emitted through a cooperative exhaust outlet 17 connected to a generally vertical duct 17***a*.

As previously stated the dryer shown in the Figures includes one example of a heated air recycle arrangement in accordance with the present invention.

More particularly, the example of a recycle arrangement shown in the Figures includes a recycle inlet conduit 18 having a mean diameter less than the mean diameter of duct 17*a* of the exhaust from dryer 1. Conduit 18 includes an inlet 19 disposed generally concentrically within duct 17*a* of air exhaust 17 where inlet 19 is, advantageously disposed downstream to receive a portion of the air flowing through duct 17. It will be noted that a portion of conduit 18 is disposed generally parallel to the longitudinal axis of conduit 17*a*.

It has been found that the arrangement shown is particularly useful when the diameter of inlet 19 of conduit 18 is approximately 75% of the diameter of duct 17*a* of conduit 17.

Figure 2:
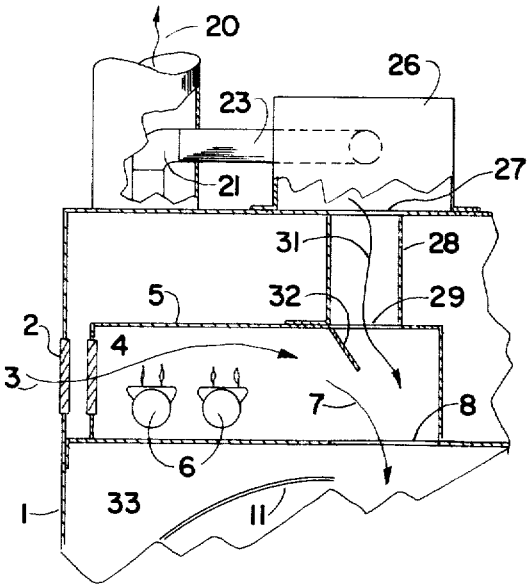
FIG. 2 is an enlargement of a view taken along line 2—2 of FIG. 1.
Figure 3:
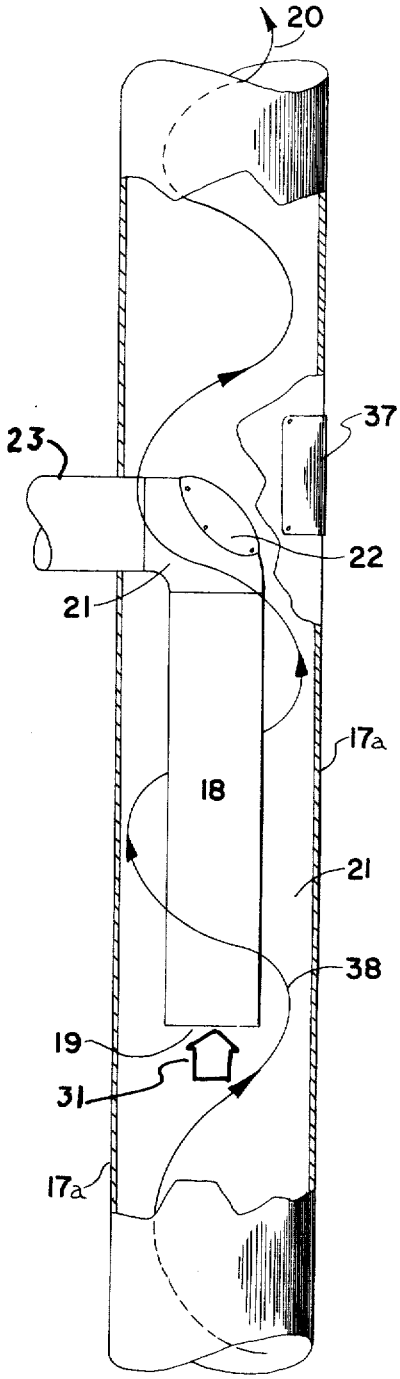
FIG. 3 is an enlargement of a view taken along line 3—3 of FIG. 1.
Figure 4:
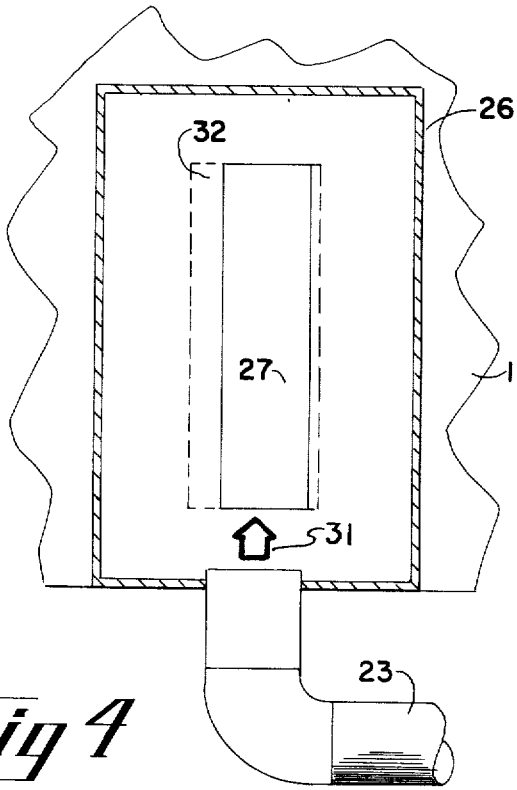
FIG. 4 is an enlargement of a view taken along line 4—4 of FIG. 1.

Referring now to FIGS. 3 and 4, conduit 18 includes an elbow section 21 located downstream from inlet 19 communicating with another duct 23 which passes through the sidewall of duct 17*a* so that the air stream 31 received by inlet 19 is removed from duct 17*a*. Duct 23 communicates as shown in FIG. 4, with a plenum 26 which can be located on top of cabinet 1 to receive the exhausted and recycled air stream 31 removed from conduit 17*a* by means of conduit 18. Referring to FIG. 2, it will be seen that air stream 31 removed from duct 17*a* and received by plenum 26 is then returned to the drying zone 33 as described hereinafter.

Referring again to FIGS. 2 and 4, it will be seen that plenum 26 can be attached to the top of cabinet 1 to communicate with an opening 29 in wall 5 of combustion chamber 4, as shown, by means of a conduit 28. A baffle 32, which can be formed when the opening is a cut in the wall 5, can be provided to direct the stream of air 31 recycled to the drying zone, and the newly heated stream of air 7, as shown. Air outlet 8, as previously described is provided for admission of the combined air stream to drying zone 33.

Referring now to FIG. 3, which shows a fragmentary view of the exhaust conduit section 17*a*, it will be noted that the conduit 17*a* includes a cover 37 for a cleanout opening in generally cooperative alignment with another clean opening covered by a cleanout cover 22, in recycle conduit elbow 21. Cleanout covers 22 and 37 can be removably fastened to conduits 21 and 17*a* for example by threaded metal screws for removal in the event conduit elbow 21 becomes plugged, for example by lint emitted from drying zone 33.

In operation of the apparatus shown in the Figures, air stream 3 is drawn through louvers 2 to combustion chamber 4 and air stream 3 and 31 are drawn through basket 11 disposed in drying zone 33 by means of blower 13, driven by motor 12, as previously described. The air stream drawn through cabinet 1 by blower 13 is emitted through exhaust 17 to conduit 17*a*. The present invention recognizes that in most applications air streams, for example stream 38, as shown in FIG. 3 is emitted from the dryer in a helical pattern as shown in FIG. 3. The force resulting from the centrifugal acceleration due to rotation of the air stream forces the heavier moisture laden air radially outwardly leaving the lighter drier air in the central portion of the conduit 17*a*. It is this lighter drier air which is received by opening 17 of recycle conduit 18 while the heavier moisture laden air passes through the annular area 21 defined between duct 18 and duct 17*a* and is emitted through outlet 20 of duct 17*a*. The air which is admitted through opening 19 to duct 17 flows through elbow 21 to duct 23 to be received in plenum 26. The air stream 31 is received in plenum 26 and is then passed through opening 27 to drying zone 33. Opening 27 can be an elongated slot running generally parallel to the axis of rotation of basket 11 and having a length generally equal to the length of basket 11 to assure adequate mixing of recycled air stream through combustion chamber 4 and burners 6 as previously described. As shown in FIG. 2, baffle 32 is provided to extend into combustion chamber 4 to direct heated air stream 7 toward outlet 8 and to facilitate mixing of air stream 7 with recycled air stream 31.

It is to be understood that the foregoing is but one example of an arrangement in accordance with the present invention, and that various other arrangements will become obvious to those skilled in the art upon reading the disclosure set forth hereinafter. Accordingly, the scope of the present invention is to be determined solely by the claims appended hereto.

We claim:

1. A heated air recycle arrangement for use in a heated air clothes dryer including a cabinet means with air supply inlet means, and an air exhaust outlet; heater means to selectively heat air supplied through said air supply inlet means; a drying zone defined within said clothes dryer cabinet means; receptacle means disposed within said drying zone to receive clothes to be dried; blower means to pass air received from said air supply means to dry clothes received by said receptacle means and to exhaust said air stream received from said air supply inlet means from said dryer cabinet through said air exhaust outlet in a generally helical flow pattern; and exhaust conduit means communicating with said exhaust outlet wherein said recycle arrangement provides: a recycle air conduit means disposed generally concentrically within said air exhaust outlet and having an inlet with a mean diameter less than the mean diameter of said exhaust conduit means and an outlet communicating with said air supply means.

2. The invention of claim 1 wherein said recycle air conduit inlet is disposed within said exhaust air conduit downstream of said dryer cabinet exhaust outlet.

3. The invention of claim 2 wherein the cross-sectional shape of said recycle air conduit means is similar to the cross sectional shape of said exhaust conduit means.

4. The invention of claim 3 wherein a portion of the length of said recycle air conduit means is disposed concentrically within said exhaust air conduit to form an annular passageway between said exhaust air conduit means and said recycle air conduit means.

5. The invention of claim 4 wherein said recycle air conduit means includes elbow means located downstream of said recycle conduit and wherein said exhaust conduit means includes aperature means to receive said elbow means and wherein said elbow means inlet extending through said aperature means provided in said exhaust conduit means.

6. The invention of claim 5 wherein said exhaust conduit means and said recycle conduit means are of generally circular cross section.

7. The invention of claim 6 wherein the diameter of recycle conduit means is 75% the diameter of said exhaust conduit means.

* * * * *